United States Patent [19]

Kuhl

[11] Patent Number: 4,712,573

[45] Date of Patent: Dec. 15, 1987

[54] APPARATUS FOR MOVABLY WASHING, RINSING AND DRYING A STATIONARY ARTICLE

[76] Inventor: Henry Y. Kuhl, P.O. Box 26, Kuhl Rd., Flemington, N.J. 08822-0026

[21] Appl. No.: 863,906

[22] Filed: May 16, 1986

[51] Int. Cl.[4] ..... B08B 3/02

[52] U.S. Cl. ..... 134/95; 134/99; 134/172; 239/288.3; 239/556; 239/752

[58] Field of Search ..... 134/95, 99, 144, 145, 134/167 R, 171, 172, 179; 239/288.3, 288.5, 556, 751, 752; 15/302, 312 R, 316 R

[56] References Cited

U.S. PATENT DOCUMENTS

| | | | |
|---|---|---|---|
| 998,579 | 7/1911 | Herz | 134/172 X |
| 1,508,495 | 9/1924 | Bacharach | 134/172 |
| 2,699,792 | 1/1955 | Fisher | 134/56 R |
| 2,703,579 | 3/1955 | Merancy et al. | 134/95 X |
| 2,788,009 | 4/1957 | Lones | 134/102 |
| 2,827,064 | 3/1958 | Heinicke | 134/172 |
| 2,896,644 | 7/1959 | Emanuel | 134/99 |
| 2,972,996 | 2/1961 | Phillips | 134/102 |
| 3,167,797 | 2/1965 | Hergonson | 15/312 R X |
| 3,171,265 | 3/1965 | Hemery et al. | 134/172 X |
| 3,181,541 | 5/1965 | Brooking | 134/186 |
| 3,242,934 | 3/1966 | Heinicke et al. | 134/99 |
| 3,349,419 | 10/1967 | Kuhl et al. | 15/3.13 |
| 3,353,546 | 11/1967 | Mahoney | 134/123 |
| 3,415,257 | 12/1968 | Wellman | 134/98 |
| 3,598,130 | 8/1971 | Nolte et al. | 134/172 X |
| 3,615,822 | 10/1971 | Molinari | 134/23 |
| 3,656,493 | 4/1972 | Black et al. | 134/113 |
| 3,664,355 | 5/1972 | Adams | 134/143 |
| 3,706,317 | 12/1972 | Fox et al. | 134/57 DL |
| 3,730,069 | 5/1973 | Bunker | 134/99 |
| 3,736,948 | 6/1973 | Crosswhite | 134/95 |
| 3,801,371 | 4/1974 | Martin | 134/99 |
| 3,831,848 | 8/1974 | Cook | 239/288.5 X |
| 3,860,020 | 1/1975 | King, Jr. | 134/111 |
| 4,019,458 | 4/1977 | Kolterer | 134/172 X |
| 4,039,350 | 8/1977 | Bucy et al. | 134/22 R |
| 4,076,033 | 2/1978 | Busse et al. | 134/172 |
| 4,211,745 | 7/1980 | Boyd | 134/102 X |
| 4,227,938 | 10/1980 | Fowler | 134/10 |
| 4,256,511 | 3/1981 | Atchison et al. | 134/172 X |
| 4,287,901 | 9/1981 | Fowler | 134/56 R |
| 4,299,245 | 11/1981 | Clapper | 134/140 |
| 4,358,341 | 11/1982 | Bergquist | 159/4 B |
| 4,408,625 | 10/1983 | Kuhl | 134/172 X |
| 4,421,132 | 12/1983 | Kuhl | 134/123 |

*Primary Examiner*—Philip R. Coe

*Attorney, Agent, or Firm*—Sperry, Zoda & Kane

[57] ABSTRACT

An apparatus is disclosed for movably washing, rinsing and drying a stationary article positioned within a housing defining a washing chamber therein. A support strut extends horizontally through the housing and a carriage means is movably mounted thereon to allow reciprocal lateral movement back and forth along the support strut. A support wheel structure rotably movable with respect to the carriage is mounted thereto and is in engagement with the support strut to facilitate this reciprocal movement. The carriage includes mounted thereon means for washing, rinsing and drying of the article positioned within the washing chamber. A drive is included including three rotatably movable pulleys and a driven sprocket. An air extractor is secured with respect to the housing to exhaust air from the washing chamber when drying air is being fed therein.

20 Claims, 3 Drawing Figures

APPARATUS FOR MOVABLY WASHING, RINSING AND DRYING A STATIONARY ARTICLE

BACKGROUND OF THE INVENTION

1. Field of the Invention

The present invention deals with the field of devices for washing relatively large items such as cabinets, carts, racks, dollies, smoke trees, and other similar items normally used in the industries of baking, beverages, confectionary, poultry, freezers, dairy, meat, eggs, fruit, fish, chocolate, candy, brewery items, pizza items, and vegetable handling.

2. Description of the Prior Art

Prior art devices utilize various means for washing of relatively large items such as those for which the present invention is intended. Normally the items are so large that it is difficult to move the items themselves therefore, the washing heads are movable.

In most prior art devices the washing heads are moved in a certain manner and the rinsing heads are moved in a similar manner and the drying heads are moved in an alternative manner. The present invention provides a single novel suspension system for a single carriage configuration which supports all three of the items which must dispense washing solution, rinsing solution, and drying air against the article to be cleaned. For this reason the apparatus of the present invention is novel in view of the various configurations attempted in the prior art.

SUMMARY OF THE INVENTION

The present invention provides an apparatus to facilitate washing, rinsing and drying of relatively large articles such as cabinets or racks. Normally such articles are difficult to rotate or move in any manner during the cleaning operation and therefore the present invention provides movable cleaning equipment.

The present invention includes a housing which defines a washing chamber therein. The housing includes an open side area to facilitate entry and exit of the article prior to and immediately after cleaning.

A support strut is fixedly secured extending laterally which respect to the housing and oriented horizontally therein. A carriage is movably mounted upon the support strut and in particular upon the upper edge thereof to allow reciprocal lateral movement thereof along the support strut. This movement is facilitated by a support wheel means which is rotatably mounted with respect to the carriage means and is engageable with respect to the support strut to movably mount the carriage means with respect thereto.

A washing conduit is fixedly secured with respect to the carriage to be movable therewith. This conduit defines a plurality of wash outlets therein to selectively release cleaning solution from the interior of the washing conduit and dispense same onto the article to be washed.

A rinsing conduit is fixedly secured with respect to the carriage means to also be movable therewith. This rinsing conduit defines rinse outlets therein to selectively release rinsing solution therefrom.

The drying conduit is fixedly secured with respect to the carriage to also be movable therewith. This drying conduit defines air outlet means to direct drying air therefrom.

A washing supply line is in fluid flow communication with respect to the washing conduits to supply cleaning solution thereto. Similarly, a rinsing supply line is in fluid flow communication with respect to the rinsing conduits to supply rinsing solution thereto. Also, an air supply line is connected with respect to the drying conduit to supply air for drying thereto.

The apparatus further includes an air extractor means in fluid flow communication with respect to the interior of the washing chamber and being operable simultaneously with the drying operation to remove expelled air from the washing chamber and facilitate air flow therein for drying.

A door may be included selectively positionable extending across the open area of the housing to fully enclose the washing chamber. The housing may also include a floor means extending across the bottom area thereof which allows drainage therethrough by being imperforate such that a reservoir can be positioned immediately below the floor to gather spent solutions therein.

The main drive mechanism for the carriage includes three pulleys rotatably mounted with respect to the housing and the fourth pulley fixedly secured with respect to the output of the drive means. A chain means extends about the three pulleys and the drive pulley and is fixedly secured with respect to the carriage to allow reciprocal movement of the carriage along the strut from one side of the washing chamber to the other and vice versa.

Preferably cutting nozzles which will facilitate cleaning by the cleaning solution will be positioned within each of the wash outlets to control the release of cleaning solution. Furthermore, rinse nozzles will be positioned within each of the rinse outlets to control the release of rinsing solution therefrom.

The air outlet means defined by the drying conduit will comprise a slot means running lontitudinally vertically along the drying conduit and will preferably be machined to a width of approximately three-eighths of an inch.

The washing conduit and the drying conduit will generally be rectangular in shape whereas the rinsing conduit is generally U-shaped. Of course, all three of these conduits can be of any configuration to facilitate washing, rinsing, or drying during reciprocal movement of the carriage.

The support wheels mounted rotatably with respect to the carriage perferably define a peripheral groove means about the outer most circumferential edge thereof such as to be engageable with respect to the upperwardly extending upper edge of the support strut. The preferred configuration is using two individual wheels to provide this wheel means each including the circumferential groove.

A plenum chamber is preferably fixedly mounted within the housing and in fluid flow communication with respect to the air outlet to supply drying air thereto to be carried to the drying conduit.

Furthermore, a blower means is included and an external air line is connected thereto to include the fluid flow communication with respect to the plenum chamber to supply drying air thereto. A first pump means and an external wash line are connected to supply cleaning solution to the washing supply line. Furthermore, a second pump means and an external rinse line are positioned to supply rinsing solution to the rinsing supply line.

A bumper means is preferably included near the lower portion of the carriage and extending rearwardly therefrom to selectively contact the rear area of the housing and prevent excessive movement of the bottom portion of the carriage means rearwardly with respect to the support strut as a result of the reaction forces exerted by the release of cleaning and rinsing solutions or drying air from the conduits secured to the carriage means. These bumpers will preferably take the form of roller means adapted to abut the rear walls of the housing and facilitate lateral movement of the carriage by rolling along while in contact with the housing.

It is an object of the present invention to provide an apparatus for movably washing, rinsing and drying relatively large stationary articles.

It is an object of the present invention to provide an apparatus for washing, rinsing and drying large cabinets and racks.

It is an object of the present invention to provide an apparatus for movably washing, rinsing and drying a stationary article wherein the wash lines, rinse lines and drying conduits are fixedly secured with respect to one another.

It is an object of the present invention to provide an apparatus for moving the washing, rinsing and drying of a stationary article wherein the dispensing outlets for said washing, rinsing and drying are movable within the washing chamber with respect to the stationary article.

It is an object of the present invention to provide an apparatus for washing, rinsing and drying a stationary article utilizing a reciprocating carriage carrying the washing, rinsing and drying outlets.

It is an object of the present invention to provide an apparatus for washing, rinsing and drying a stationary article utilizing a reciprocating chain drive for moving a carriage which holds the washing, rinsing and drying conduits.

It is an object of the present invention to provide an apparatus for movably washing, rinsing and drying a stationary article which includes an air extractor which is operated simultaneously with the drying step to facilitate the flow of drying air.

It is an object of the present invention to provide an apparatus for movably washing, rinsing and drying a stationary article utilizing an imperforate floor means extending across the bottom of the washing chamber and a reservoir positioned immediately below the floor means to gather spent solutions.

It is an object of the present invention to provide an apparatus for movably washing, rinsing and drying a stationary article which is relatively inexpensive compared with conventional means of such cleaning.

It is an object of the present invention to provide an apparatus for movably washing, rinsing and drying a stationary article which has relatively simple and inexpensive maintenance requirements.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
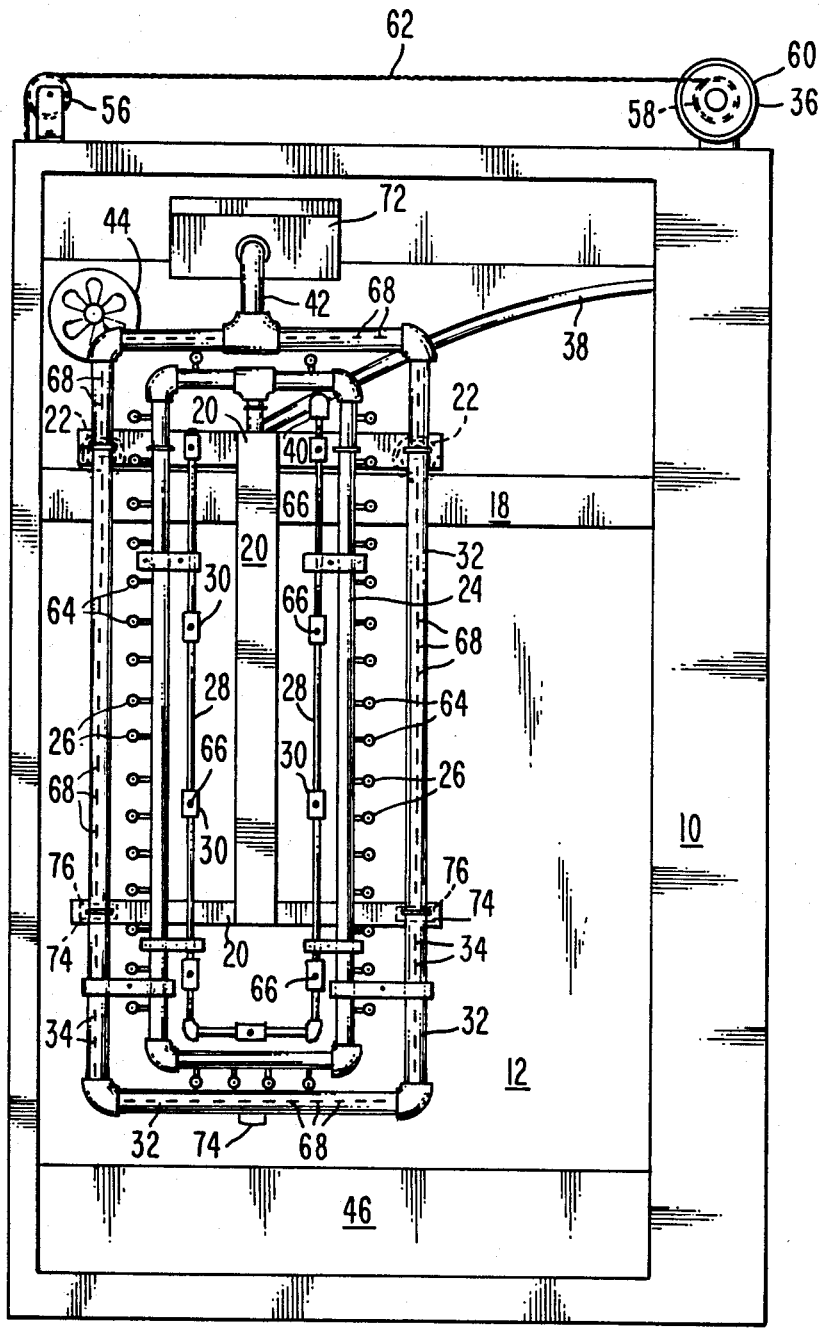
FIG. 1 is a front plan view of an embodiment of the apparatus for movably washing, rinsing and drying a stationary article.

The present invention provides an apparatus for movably washing, rinsing and drying a stationary article positioned within a housing 10. Housing 10 can generally take the form of any shape enclosure which defines a washing chamber 12 therein. One section of the housing 10 will be open to define an open area 14 to allow the stationary article to be admitted and withdrawn from positioning within the washing chamber. A door means 16 may be selectively positionable extending across this open area 14 for substantially closing the washing chamber 12 during washing, rinsing and drying therein.

A support strut means 18 will extend horizontally across the washing chamber 12 and be secured at each opposite end with respect to housing 10. A carriage means 20 will be movably mounted upon the support strut means 18 such as to be movable therealong during reciprocable movement of carriage means 20 with respect to housing 10 and an article positioned therein. To facilitate this movement, a support wheel means 22 which may preferably take the form of two individual wheels will be rotatably secured with respect to carriage means 20.

Preferably support wheels 22 will include a peripheral groove means 70 extending about the outer most circumference peripherally therearound. This peripheral groove will be oriented in a vertical direction such as to encase the upper edge of support strut means 18 to movably secure carriage means 20 with respect to support strut means 18. As the support wheel means 22 rotates, carriage means 20 will move laterally across the washing chamber 12 along the upper edge of support strut means 18. This will allow reciprocating movement of the carriage means 20 with respect to an article to be washed.

Fixedly secured with respect to carriage means 20 will be a washing conduit 24. This conduit will be generally rectangular and will include a plurality of wash outlet means 26 located therealong for release of cleaning solution from the interior of said washing conduit 24. A plurality of cutting nozzles 64 will be positionable extending into each of the individual wash outlets 26 in such a manner as to guide the cleaning solution in chosen spray patterns to facilitate cleaning by the cleaning solution. A washing supply line 38 will be connected in fluid flow communication with respect to washing conduit 24 to supply cleaning solution thereto.

A rinsing conduit 28 of a generally U-shaped configuration will be fixedly secured with respect to carriage means 20. Rinsing conduit 28 will define a plurality of rinse outlets 30 therealong each of which may be configured to have mounted therein a rinse nozzle 66. These rinse nozzles 66 are particularly adapted for dispensing rinsing solution for the removal of cleaning solution from the immediately previously washed article or for the application of a sanitizing spray.

A drying conduit 32 which may be rectangular in configuration will be fixedly secured with respect to carriage means 20 and will define a plurality of air outlet means 34 therealong. The air outlet means will preferably take the form of a slot means 68. In the preferred configuration, this slot will extend longitudinally vertically along the drying conduit 32 and be machined directly into the conduit to a lateral width of approximately three-eighths of an inch.

A rinsing supply line 40 will be connected in fluid flow communication with respect to rinsing conduit 28 to supply rinsing solution thereto. In a similar manner, an air supply line 42 will be in fluid flow communication with respect to drying conduit 32 to supply drying air thereto.

A drive means 36 may be mounted with respect to the housing to effect powering of the reciprocal movement of carriage means 20. Also an air extractor means 44 may be positioned adjacent to housing 10 and in fluid flow communication with respect to washing chamber 12. Air extractor means 44 will be operable simultaneously with the step of drying in order to remove spent air from the washing chamber 12 to more readily facilitate flow of drying air through drying conduits 32.

Housing 10 will preferably include a floor means 46 extending across the bottom area thereof which is perforated such as to allow spent cleaning and rinsing solution to pass downwardly therethrough. A reservoir means 48 is preferably included positioned immediately below floor means 46 to gather the spent solution passing therethrough for disposal.

Figure 3:
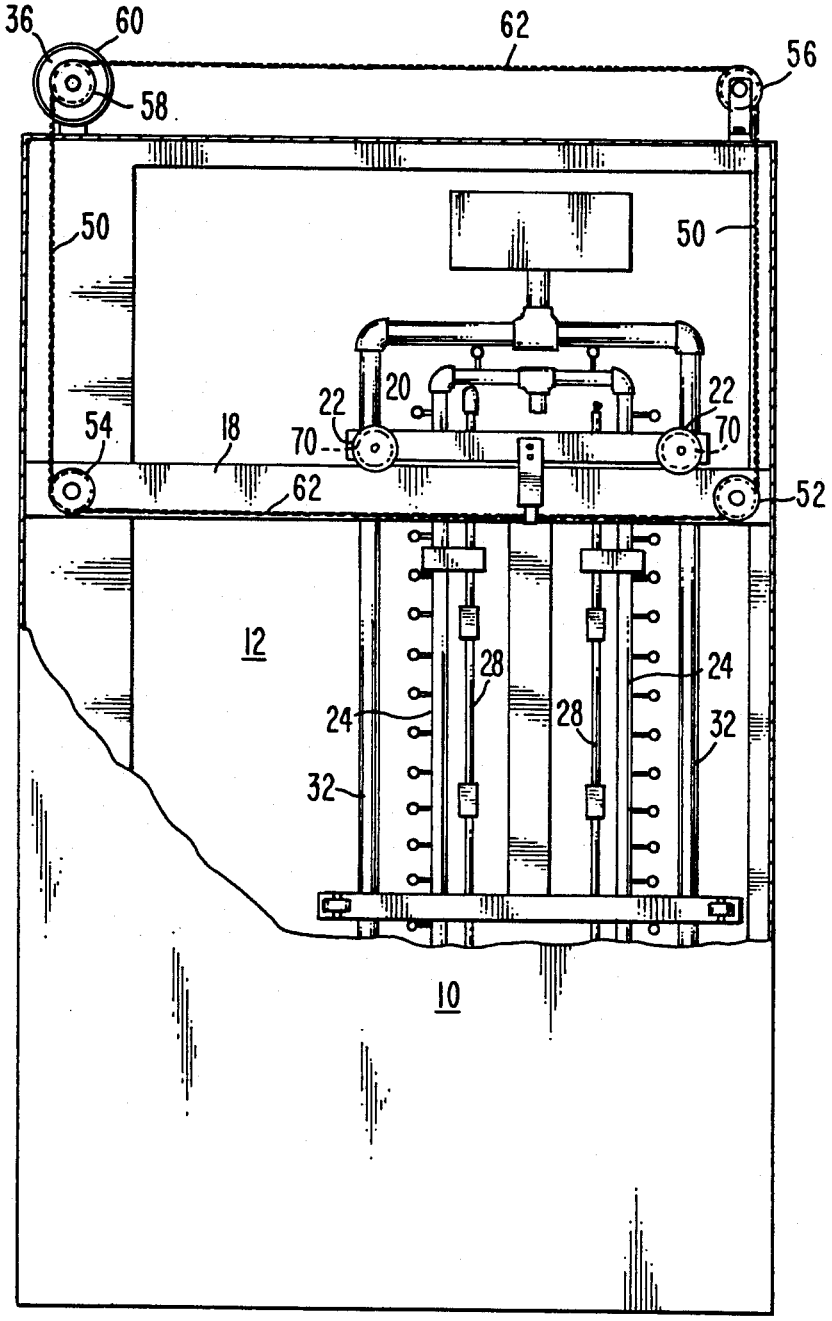
FIG. 3 is a rear plan view of the embodiment shown in FIG. 1.

A drive mechanism 60 may be included which includes a first pulley means 52 and a second pulley means 54 both positioned rotatably secured with respect to the interior of housing 10. In the preferred configuration as set forth in FIG. 3, the drive mechanism will include a third pulley means 56 secured to the top of the housing immediately thereabove. Also a drive pulley means 58 will be positioned also movably secured with respect to the top of the housing immediately thereabove. Drive means 34 may take the form of a motor means 60 which is fixedly secured with respect to drive pulley 58 for direct drive thereof. A drive chain means 62 may be positioned extending around the first pulley means 52, the second pulley means 54, the third pulley means 56 and the drive pulley means 58. In this manner, driving of motor means 60 in selectively opposite directions will cause reciprocal movement of the drive chain means 52 over the four pulleys. This drive chain means will also be fixedly secured at one point with respect to the carriage means 20 thereby achieving reciprocal movement thereof along the upper edge of support strut means 18.

A plenum chamber 72 may be defined adjacent to housing 10 to receive air under pressure therein and will be in fluid flow communication with respect to air supply line 42 to provide air to drying conduit 32 for dispensing through slot means 68.

To maintain vertical orientation of the carriage means 20 with respect to the article to be washed, a bumper means 74 may be positioned in the lower area thereof extending rearwardly toward the rear wall of housing 10. As washing solution, rinsing solution or air is expelled from one of the conduits secured with respect to the carriage 20, the lower end of the carriage will tend to be urged by the reactive force away from the article toward the rear of the housing. This bumper will then prevent damage to either the rear of the housing or to the carriage or conduits thereon. Preferably this bumper means 74 will take the form of a roller means 76 which may be in constant contact with the rear wall and will travel therealong to achieve a vertical orientation continously.

Figure 2:
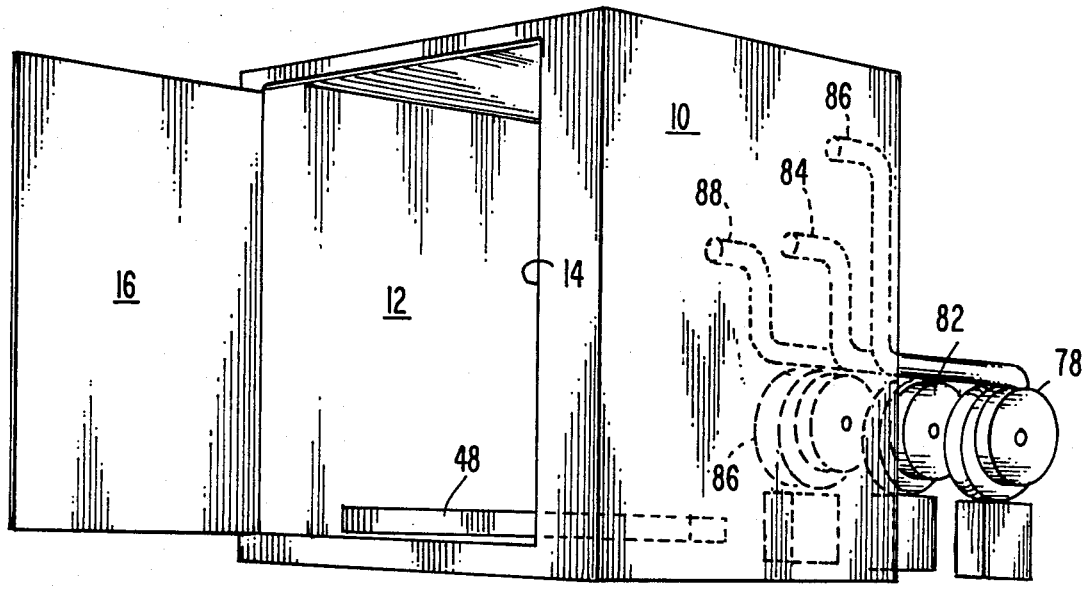
FIG. 2 is perspective view of the embodiment shown in FIG. 1.

A blower means 78 as shown in FIG. 2 may be connected with respect to an external airline 80 which communicates air from blower means 78 therethrough to plenum chamber 72. Furthermore, a first pump means 82 may be in fluid flow communication with respect to an external wash line 84 and is positioned to pump cleaning solution through line 84 which is in fluid flow communication with respect to washing conduit 24 for supplying this cleaning solution thereto.

Similarly, a second pump means 86 may be positioned external with respect to housing 10 and in fluid flow communication with external rinse line 88 to supply rinsing solution thereto. External rinse line 88 will then in turn be in fluid flow communication with respect to rinsing supply line 40 to supply rinsing solution thereto. It is also possible that the present invention will include a controller means to vary the amount of time required for the washing, rinsing, sanitizing or drying steps. This controller means could include solenoid means or other conventional manners of controlling which step the conduits carried by the carriage will be activated.

In operation the drive means 36 of the present invention will, by reciprocal movement, cause the carriage means 20 to move back and forth from one wall of washing chamber 12 to the opposite wall along the direction determined by the support strut means 18. During this reciprocal movement the washing, rinsing, sanitizing or drying fluid will be expelled toward the article to be washed. This arrangement allows for a simple single structure for carrying the four different steps which are normally achieved individually or manually under such configuration.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for movably washing, rinsing and drying a stationary article comprising:

(a) a housing means defining a washing chamber therein, said housing means including an open area to allow entry and exit of the article to be cleaned within said washing chamber;

(b) a support strut means fixedly secured with respect to said housing means and extending laterally and horizontally through said washing chamber;

(c) a carriage means movably mounted on said support strut means to allow lateral movement thereof along said support strut means;

(d) a support wheel means rotatably mounted with respect to said carriage means and engageable with respect to said support strut means to movably mount said carriage means with respect thereto;

(e) a washing conduit fixedly secured with respect to said carriage means to be movable therewith, said washing conduit defining wash outlet means therein to selectively release cleaning solution therefrom;

(f) a rinsing conduit fixedly secured with respect to said carriage means to be movable therewith, said rinsing conduit defining rinse outlet means therein to selectively release rinsing solution therefrom;

(g) a drive means secured with respect to said carriage means for reciprocal movement thereof;

(h) a washing supply line in fluid flow communication with respect to said washing conduit to supply cleaning solution thereto;

(i) a rinsing supply line in fluid flow communication with respect to said rinsing conduit to supply rinsing solution thereto; and (j) a bumper means fixedly secured with respect to said carriage means and extending rearwardly therefrom to selectively contact the rear area of said housing means and prevent excessive movement of said carriage means with respect to said support strut means as a result of reaction forces exerted by release of cleaning and rinsing solutions from the conduits secured to said carriage means.

2. The apparatus as defined in claim 1 further including:

(a) a drying conduit fixedly secured with respect to said carriage means to be movable therewith, said drying conduit defining air outlet means to direct drying air therefrom;

(b) an air supply line in fluid flow communication with respect to said drying conduit to supply air for drying thereto; and (c) air extractor means in fluid flow communication with respect to said washing chamber and being operable simultaneously with drying to remove expelled air from said washing chamber to facilitate air flow for drying.

3. The apparatus as defined in claim 2 wherein said air outlet means comprises a slot means extending longitudinally along said drying conduit.

4. The apparatus as defined in claim 3 wherein said slot means is machined to a width of approximately three-eighths of an inch.

5. The apparatus as defined in claim 2 wherein said drying conduit is generally rectangular in shape.

6. The apparatus as defined in claim 2 further including a plenum chamber fixedly mounted with respect to said housing and in fluid flow communication with respect to said air outlet means to supply drying air thereto to be carried to said drying conduit.

7. The apparatus as defined in claim 6 further comprising a blower means and an external air line in fluid flow communication with respect to said plenum chamber to supply drying air thereto.

8. The apparatus as defined in claim 1 further comprising a door means selectively positionable extending across said open area of said housing means to fully enclose said washing chamber defined therein.

9. The apparatus as defined in claim 1 wherein said housing means further includes an perforated floor means extending across the bottom area thereof and wherein said apparatus further includes a reservoir means positioned immediately below said floor means to gather spent solutions therein.

10. The apparatus as defined in claim 1 further comprising a drive mechanism which includes:

(a) a first pulley means rotatably mounted with respect to said housing means at one end of said support strut means;

(b) a second pulley means rotatably mounted with respect to said housing means at the other end of said support strut means;

(c) a third pulley means rotatably mounted with respect to the top of said housing means;

(d) a drive pulley means fixedly secured to the output of said drive means to be rotatable therewith;

(e) a drive chain means extending about said first pulley means, said second pulley means and said third pulley means to be rotatable therewith, said drive chain means also extending about said drive pulley means to be driven therewith, said drive means being fixedly secured with respect to said carriage means to urge movement thereof responsive to actuation of said drive means.

11. The apparatus as defined in claim 1 further including cutting nozzles positioned within each of said wash outlet means to control the release of cleaning solution from said washing conduit.

12. The apparatus as defined in claim 1 further including rinse nozzles positioned within each of said rinse outlet means to control the release of rinsing solution from said rinsing conduit.

13. The apparatus as defined in claim 1 wherein said washing conduit is generally rectangular in shape.

14. The apparatus as defined in claim 1 wherein said rinsing conduit is generally U-shaped.

15. The apparatus as defined in claim 1 wherein said support wheel means includes a peripheral groove means about the outermost circumferential edge thereof to be engageable with respect to the upper edge of said support strut means to facilitate support of said carriage means with respect thereto.

16. The apparatus as defined in claim 15 wherein said support wheel means includes two individual wheel means mounted laterally along said carriage means to facilitate support thereof with respect to said support strut means.

17. The apparatus as defined in claim 1 wherein said bumper means comprises roller means adapted to abut the rear walls of said housing means and facilitate lateral movement of said carriage means by rolling therealong.

18. The apparatus as defined in claim 1 further comprising a first pump means and an external wash line to supply cleaning solution to said washing supply line.

19. The apparatus as defined in claim 1 further comprising a second pump means and an external rinse line to supply rinsing solution to said rinsing supply line.

20. An apparatus for movably washing, rinsing and drying a stationary article comprising:

(a) a housing means defining a washing chamber therein, said housing means including an open area to allow entry and exit of the article to be cleaned within said washing chamber, said housing means further including a door means selectively positionable extending across said open area of said housing means to enclose said washing chamber defined therein, said housing means further defining an imperforate floor means extending across the bottom area thereof;

(b) a support strut means fixedly secured with respect to said housing means and extending laterally and horizontally through said washing chamber;

(c) a carriage means movably mounted on said support strut means to allow lateral movement thereof along said support strut means;

(d) a support wheel means rotatably mounted with respect to said carriage means and engageable with respect to said support strut means to movably mount said carriage means with respect thereto, said support wheel means comprising two wheel means each defining a peripheral groove means about the outermost circumferential edges thereto to be engageable with respect to the upper edge of said support strut means to facilitate support of said carriage means with respect thereto;

(e) a washing conduit fixedly secured with respect to said carriage means to be movable therewith, said washing conduit defining wash outlet means therein to selectively release cleaning solution therefrom, said washing conduit being generally rectangular in shape;

(f) cutting nozzles positioned within each of said wash outlet means to control the release of cleaning solution from said washing conduit;

(g) a rinsing conduit being generally U-shaped and fixedly secured with respect to said carriage means to be movable therewith, said rinsing conduit defining rinse outlet means therein to selectively release rinsing solution therefrom;

(h) rinse nozzles positioned within each of said rinse outlet means to control the release of rinsing solution from said rinsing conduit;

(i) a drying conduit being generally rectangular in shape and fixedly secured with respect to said carriage means to be movable therewith, said drying conduit defining an air outlet means to direct drying air therefrom, said air outlet means comprising a machined slot means extending longitudinally along said drying conduit and being approximately three-eighths of an inch in width;

(j) a drive means secured with respect to said carriage means for reciprocal movement thereof;

(k) a washing supply line in fluid flow communication with respect to said washing conduit to supply cleaning solution thereto;

(l) a rinsing supply line in fluid flow communication with respect to said rinsing conduit to supply rinsing solution thereto;

(m) an air supply line in fluid flow communication with respect to said drying conduit to supply air for drying thereto;

(n) air extractor means in fluid flow communication with respect to said washing chamber and being operable simultaneously with drying to remove expelled air from said washing chamber to facilitate air flow for drying;

(o) a reservoir means positioned immediately below said floor means to gather spent solutions therein;

(p) a drive mechanism which includes:

(1) a first pulley means rotatably mounted with respect to said housing means at one end of said support strut means;

(2) a second pulley means rotatably mounted with respect to said housing means at the other end of said support strut means;

(3) a third pulley means rotatably mounted with respect to the top of said housing means;

(4) a drive pulley means fixedly secured to the output of said drive means to be rotatable therewith;

(5) a drive chain means extending about said first pulley means, said second pulley means and said third pulley means to be rotatable therewith, said drive chain means also extending about said drive pulley means to be driven therewith, said drive means being fixedly secured with respect to said carriage means to urge movement thereof responsive to actuation of said drive means;

(q) a plenum chamber means secured with respect to said housing and in fluid flow communication with respect to said air outlet means to supply drying air thereto to be carried to said drying conduit;

(r) a bumper means fixedly secured with respect to said carriage means and extending rearwardly therefrom to selectively contact the rear area of said housing means and prevent excessive movement of said carriage means with respect to said support strut means as a result of reaction forces exerted by release of cleaning and rinsing solutions and drying air from the conduits secured to said carriage means, said bumper means specifically comprising roller means adapted to abut the rear wall of said housing means and facilitate lateral movement of said carriage means by rolling therealong;

(s) a blower means and an external air line in fluid flow communication with respect to said plenum chamber to supply drying air thereto;

(t) a first pump means and an external wash line to supply cleaning solution to said washing supply line; and (u) a second pump means and an external rinse line to supply rinsing solution to said rinsing supply line.

* * * * *